US009227202B2

(12) United States Patent
Yu

(10) Patent No.: US 9,227,202 B2
(45) Date of Patent: Jan. 5, 2016

(54) PORTABLE SHOWER HEAD WITH AIR INLET COVER

(75) Inventor: Zhangjun Yu, Zhangzhou (CN)

(73) Assignee: SINYU TECHNOLOGY (FUJIAN) CO., LTD., Zhangzhou, Fujian (CN)

( * ) Notice: Subject to any disclaimer, the term of this patent is extended or adjusted under 35 U.S.C. 154(b) by 114 days.

(21) Appl. No.: 13/812,262

(22) PCT Filed: Sep. 13, 2010

(86) PCT No.: PCT/CN2010/076831

§ 371 (c)(1),
(2), (4) Date: Jan. 25, 2013

(87) PCT Pub. No.: WO2012/012960

PCT Pub. Date: Feb. 2, 2012

(65) Prior Publication Data

US 2013/0119160 A1 May 16, 2013

(30) Foreign Application Priority Data

Jul. 29, 2010 (CN) ..... 2010 2 0280521 U

(51) Int. Cl.

| | |
|---|---|
| ***B05B 1/00*** | (2006.01) |
| ***B05B 1/18*** | (2006.01) |
| ***B05B 7/04*** | (2006.01) |
| ***E03C 1/04*** | (2006.01) |

(52) U.S. Cl.
CPC . *B05B 1/00* (2013.01); *B05B 1/185* (2013.01); *B05B 7/0425* (2013.01); *E03C 1/0409* (2013.01)

(58) Field of Classification Search
None
See application file for complete search history.

(56) References Cited

U.S. PATENT DOCUMENTS

| | | | | |
|---|---|---|---|---|
| 2003/0121993 | A1 * | 7/2003 | Haverstraw et al. | 239/443 |
| 2004/0074993 | A1 * | 4/2004 | Thomas et al. | 239/525 |
| 2009/0090793 | A1 * | 4/2009 | Ichige | 239/428.5 |
| 2011/0297759 | A1 * | 12/2011 | Morbio | 239/428.5 |

FOREIGN PATENT DOCUMENTS

| | | | | |
|---|---|---|---|---|
| IT | BS2009A000031 | * | 2/2009 | 239/428.5 |

* cited by examiner

*Primary Examiner* — Len Tran
*Assistant Examiner* — Adam J Rogers

(57) ABSTRACT

A portable shower head with an air inlet cover includes a decorative cover, a middle cover with soft rubber nozzles and a shower head body. Two air holes are provided on the middle cover. An air inlet connector with a hollow water channel is provided in the front part of the cavity of the shower head handle, and on the air inlet connector, air inlet holes are provided. A second inner wall is set in the front part of the cavity of the shower head handle. A front end sealing ring of the air inlet connector seals the second inner wall. A middle sealing ring of the air inlet connector seals a first inner wall of the shower head handle, so as to form the air space. A tail end sealing ring of the air inlet connector seals a water inlet pipe.

1 Claim, 3 Drawing Sheets

PORTABLE SHOWER HEAD WITH AIR INLET COVER

BACKGROUND OF THE INVENTION

1. Field of the Invention

The present invention relates to an air inlet portable shower head, and more particularly to a portable shower head with an air inlet cover.

2. Description of the Prior Art

A conventional air inlet portable shower head has air inlet holes disposed at the handle of the shower head. When switching off the water, the remaining water will flow out from the air inlet holes of the handle of the shower head. The user may feel uncomfortable when the shower head is leaking water. Accordingly, the inventor of the present invention has devoted himself based on his many years of practical experiences to solve these problems.

SUMMARY OF THE INVENTION

The primary object of the present invention is to provide a portable shower head with an air inlet cover, preventing the shower head from leaking after switching off.

In order to achieve the aforesaid object, the portable shower head with an air inlet cover of the present invention comprises a decorative cover, a middle cover with soft rubber nozzles, and a shower head body. The decorative cover and the middle cover are connected by welding to form an air chamber therebetween. The middle cover has two air holes thereon. The two air holes communicate with the shower head body and an air space in a front part of a cavity of a shower head handle of the shower head body. An air inlet connector with a hollow water channel is provided in the front part of the cavity of the shower head handle. The air inlet connector has an air inlet hole thereon to communicate with the hollow water channel. The air inlet hole is located in the air space. The front part of the cavity of the shower head handle has a second inner wall. The air inlet connector is provided with a front end sealing ring to seal the second inner wall. The air inlet connector is provided with a middle sealing ring to seal a first inner wall of the shower head handle so as to form the air space. The air inlet connector is provided with a tail end sealing ring to seal a water inlet pipe so as to seal water.

The effect of the present invention is that air enters the air chamber formed between the decorative cover and the middle cover through the gap between the decorative cover and the soft rubber nozzles, and flows to the air space at the front part of the cavity of the shower head handle of the shower head body through the two air holes of the middle cover, and then enters the hollow water channel through the air inlet hole to mix with water to form aerobic water. Thus, the remaining water formed by reflux after switching off is remained in the air chamber, and the remaining water will enter the water channel with the air while switching on the next time.

DETAILED DESCRIPTION OF THE PREFERRED EMBODIMENTS

Figure 1:
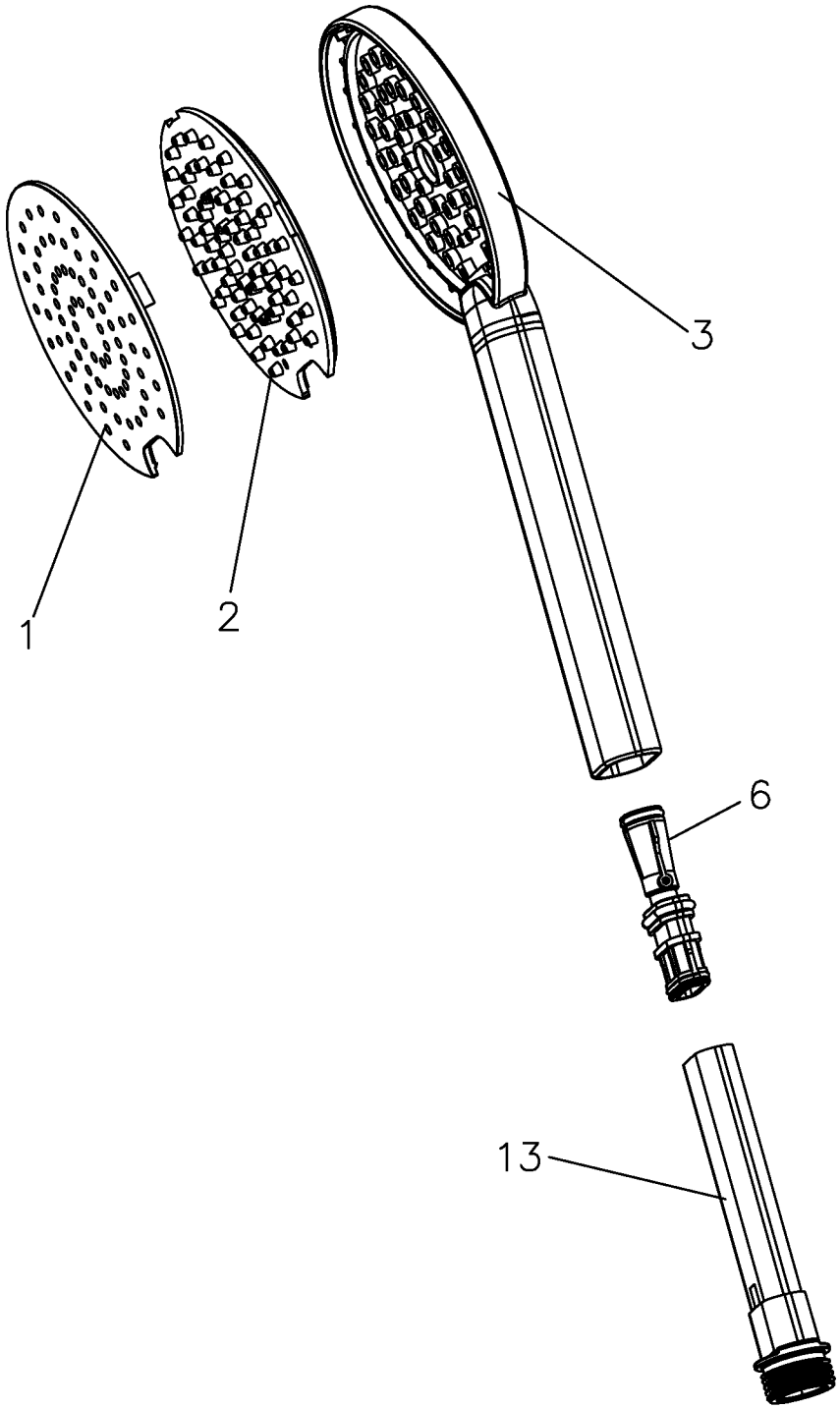
FIG. 1 is an exploded view of the present invention.
Figure 2:
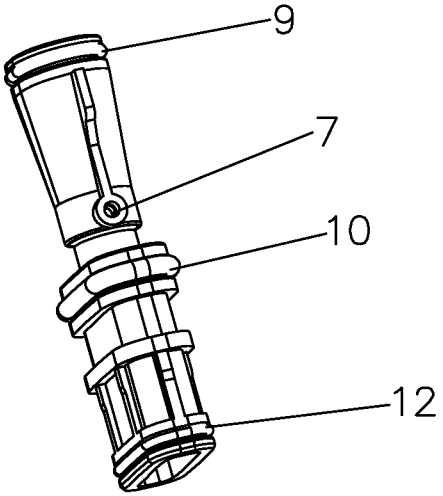
FIG. 2 is a perspective view showing the air inlet connector of the present invention.

Embodiments of the present invention will now be described, by way of example only, with reference to the accompanying drawings.

As shown in FIG. 1 to FIG. 5, the portable shower head with an air inlet cover of the present invention comprises a decorative cover 1, a middle cover 2 with soft rubber nozzles, and a shower head body 3.

The decorative cover 1 and the middle cover 2 are connected by welding to form an air chamber therebetween.

The middle cover 2 has two air holes 4 thereon. The two air holes 4 communicate with the shower head body 3 and an air space 5 in a front part of a cavity of a shower head handle of the shower head body 3.

An air inlet connector 6 with a hollow water channel is provided in the front part of the cavity of the shower head handle. The air inlet connector 6 has an air inlet hole 7 thereon to communicate with the hollow water channel. The air inlet hole 7 is located in the air space 5. The shower head handle has a first inner wall 11, and the front part of the cavity of the shower head handle has a second inner wall 8.

Figure 3:
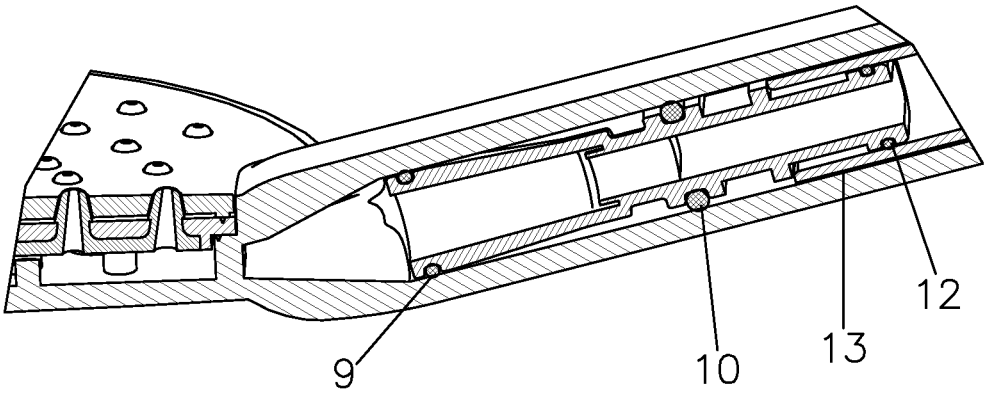
FIG. 3 is a partial sectional view of the present invention.
Figure 4:
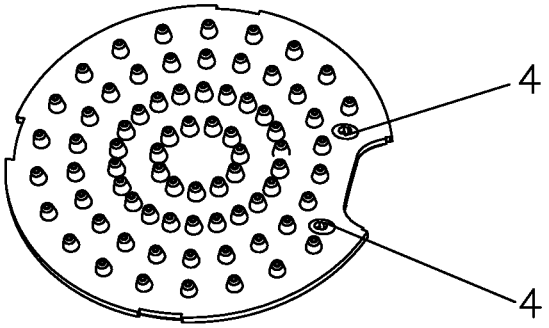
FIG. 4 is a schematic view showing the middle cover with soft rubber nozzles of the present invention.
Figure 5:
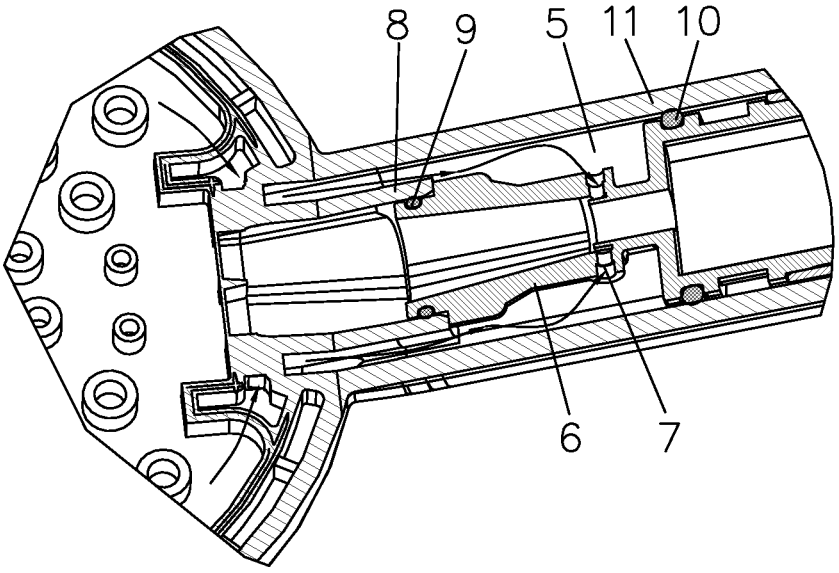
FIG. 5 is another partial sectional view of the present invention.

As shown in FIG. 3 and FIG. 5, to assemble the present invention, the air inlet connector 6 is first inserted into a water inlet pipe 13, and then the water inlet pipe 13 is inserted into the shower head handle. The air inlet connector 6 is provided with a front end sealing ring 9 to seal the second inner wall 8. The air inlet connector 6 is provided with a middle sealing ring 10 to seal the first inner wall 11 of the shower head handle so as to form the air space 5. The air inlet connector 6 is provided with a tail end sealing ring 12 to seal the water inlet pipe 13 so as to seal water. As shown in FIG. 5, the arrow shows the air inlet direction.

As shown in FIG. 5, the arrow shows the air flow direction when in use. The air enters the air chamber formed between the decorative cover 1 and the middle cover 2 through the gap between the decorative cover 1 and the soft rubber nozzles, and flows to the air space 5 at the front part of the cavity of the shower head handle of the shower head body 3 through the two air holes 4 of the middle cover 2, and then enters the hollow water channel through the air inlet hole 7 to mix with water to form aerobic water. Thus, the remaining water formed by reflux after switching off is remained in the air chamber, and the remaining water will enter the water channel with the air while switching on the next time.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A portable shower head with an air inlet cover, comprising a decorative cover, a middle cover including axially oriented soft rubber nozzles disposed on a front side thereof, and a shower head body, including a shower head handle, an elongated extension for holding, including a cavity for enclosing a water inlet pipe within;

an air inlet connector, coaxially enclosed inside the water inlet pipe; and a front end sealing ring, a middle sealing ring, and a tail end sealing ring, coaxially oriented to one another and enclosed inside the water inlet pipe from top to down orderly, with the decorative cover, and the shower head body coaxially connected and configured to correspond to the axially oriented soft rubber nozzles;

the middle cover having two air holes disposed on the front side, each of which communicating independently with the shower head body, and with an air space extending along the shower head handle in a front part of a cavity of the shower head handle;

the air inlet connector including a hollow water channel coaxially defined by a connector inner wall thereof provided in the front part of the cavity of the shower head handle, and an air inlet hole formed at a rear part of the air space to communicate with the hollow water channel, the front part of the cavity of the shower head handle having a second inner wall, the air inlet connector being provided with a front end sealing ring to seal the second inner wall, with a middle sealing ring to seal a first inner wall of the shower head handle to form the air space, and with a tail end sealing ring to seal a water inlet pipe to seal water, wherein the first inner wall and the second inner wall are directly connected at a front end thereof and disjoint at another end of the shower head handle in an elongated U-shape to form a front part of the air space, with a diameter defined within the elongated U-shape less than that defined elsewhere within the air space, and air enters an air chamber formed between the decorative cover and the middle cover via a gap between the decorative cover and the soft rubber nozzles, then, flows to the air space at the front part of the cavity of the shower head handle via the two air holes of the middle cover, and finally enters the hollow water channel through the air inlet hole to mix with water to form aerobic water such that water from reflux when the shower head is turned off would stay in the air chamber, and flows into the water channel when the shower head is turned on again.

* * * * *